US006206807B1

(12) United States Patent
Cowans et al.

(10) Patent No.: US 6,206,807 B1
(45) Date of Patent: Mar. 27, 2001

(54) ANKLE EXERCISE DEVICE

(75) Inventors: Jerry W. Cowans, Cincinnati; Douglas B. Van Atta, Milford; Philip M. Amato, Batavia, all of OH (US)

(73) Assignee: Anklcisor, Inc., Cincinnati, OH (US)

( * ) Notice: Subject to any disclaimer, the term of this patent is extended or adjusted under 35 U.S.C. 154(b) by 0 days.

(21) Appl. No.: 09/195,530

(22) Filed: Nov. 18, 1998

(51) Int. Cl.[7] ..... A63B 21/00

(52) U.S. Cl. ..... 482/79; 482/80; 601/33; 601/34

(58) Field of Search ..... 601/33, 34; 482/124, 482/122, 129, 44, 45, 10, 79, 80, 121, 128, 139, 126; 128/882

(56) References Cited

U.S. PATENT DOCUMENTS

| | | | | |
|---|---|---|---|---|
| 324,498 | | 8/1885 | Surbaugh . | |
| 745,154 | | 11/1903 | Chlada . | |
| 1,546,506 | | 7/1925 | Naysmith . | |
| 2,772,881 | | 12/1956 | Fundom . | |
| 4,003,374 | | 1/1977 | Mizrachy . | |
| 4,306,714 | | 12/1981 | Loomis et al. . | |
| 4,432,543 | | 2/1984 | Normandin . | |
| 4,474,176 | * | 10/1984 | Farris et al. | 128/125 B |
| 4,538,595 | * | 9/1985 | Hajianpour | 601/34 |
| 4,669,450 | * | 6/1987 | Lindberg | 601/33 |
| 4,784,121 | | 11/1988 | Brooks . | |
| 4,979,737 | | 12/1990 | Kock . | |
| 5,069,446 | | 12/1991 | Larson . | |
| 5,100,129 | | 3/1992 | Porter et al. . | |
| 5,236,333 | | 8/1993 | Barba, Jr. . | |
| 5,277,680 | | 1/1994 | Johnston . | |
| 5,489,251 | | 2/1996 | Robles, Jr. . | |
| 5,582,579 | | 12/1996 | Chism et al. . | |
| 5,853,354 | * | 12/1998 | Kubota | 482/80 |

OTHER PUBLICATIONS

American Academy of Orthotists and Prosthetists, *Plastic Ankle–Foot Orthosis,* Care & Use Guide.

USMC United States Manufacturing Company, *Home Stretch By USMC,* Advertisement/Ordering Information Sheet.

Orthomerica Products, Inc., *UFO Universal Plantar Fascitis Orthosis,* Advertisement/Ordering Information Sheet.

* cited by examiner

*Primary Examiner*—Jerome W. Donnelly
(74) *Attorney, Agent, or Firm*—Wood, Herron & Evans, L.L.P.

(57) ABSTRACT

An ankle exercise device having a lower leg section receiving a calf portion of a lower leg of a user and a foot section receiving a foot of the user. The lower leg section is rotatably connected near the heel end of the foot section. A rigid control rod has one end connectable to the foot section and an opposite end held by the user. Thus, as the user successively pushes and pulls the control rod, the foot section is pivoted with respect to the lower leg section, thereby exercising the ankle-foot complex.

14 Claims, 1 Drawing Sheet

ANKLE EXERCISE DEVICE

BACKGROUND OF THE INVENTION

This invention relates generally to exercise devices and more particularly, to an ankle exercise device. There are numerous deficits affecting the ankle-foot complex, that is, the ability to use the ankle joint to move the foot with respect to the lower leg. For purposes of this application, the ankle-foot complex includes the skeletal structure of the ankle and foot and the surrounding muscle, nerves and tissues, or a portion of the ankle-foot complex; and the lower leg generally refers to the shank, that is, the portion of the leg between the knee and the ankle. Some deficits limit the range of motion of the foot with respect to the lower leg. Other deficits limit the strength of the muscles that move the foot. Such deficits may be congenital, acquired, orthopaedic, vascular or neurological. Such deficits may be caused by hemiplegia, paraplegia, quadriplegia, spinal cord injury, brain injury, CVA, diabetes, vascular problems, peripheral neuropathy, foot drop, fracture, contracture, heel cord repair, spinabifida, cerebral palsy, etc. Of particular interest, are those deficits which inhibit dorsiflexion, that is, the ability to pivot the foot with the ankle joint in an upward direction with respect to a horizontal axis passing through the ankle joint and plantarflexion, which is the ability to use the ankle joint to rotate the foot downward with respect to a generally horizontal axis passing through the ankle joint. For example, with one such deficit, which in the literature and this application is referred to as either "foot drop" or "drop foot", the motor control of dorsiflexion is impaired and may be completely inhibited. Thus, because of muscle or nerve damage, there is no ability to use the ankle-foot complex to lift the foot, and the foot hangs in a fully dropped position with respect to the lower leg.

There are exercise devices that may be used to provide physical therapy to improve deficits affecting the ankle. For example, some users can generally control the motion of their feet, but they may have deficits with respect to muscle strength and/or range of motion of the foot. There are exercise devices for such deficits which attach to the ball of the foot and provide a resistance to the user moving the foot in a dorsiflexion or plantarflexion motion. Further, the resistance to such motion is often variable so that muscle strength and range of motion may be restored. With other devices, the foot is resiliently held at the extreme of the dorsiflexion or plantarflexion position over extended periods of time, for example, overnight; and such devices assist the user in increasing the range of motion of the foot.

With other deficits, more complicated motorized foot articulators are known which reciprocate the foot through successive dorsiflexion and plantarflexion motions. Such motions may complement or resist muscular activity of the user. While all of the above described devices provide beneficial, therapeutic value, such devices are not beneficial or useful with respect to every deficit of the ankle-foot complex. For example, with a foot drop condition, one has no ability to move the foot; and thus, devices that are designed to provide a resistance to muscular activity cannot be used with a foot drop deficit. Further, motorized exercise devices for moving the foot are expensive, complicated, difficult to move and not readily used in a home environment.

Consequently, there is a need for an ankle exercise device that does not have the limitations and disadvantages of known ankle exercise devices.

SUMMARY OF THE INVENTION

The present invention provides a simple, inexpensive, reliable ankle exercise device which is suitable for severe ankle deficits, for example, foot drop, and can be easily used by a user in a home environment. The ankle exercise device of the present invention permits the user to easily manually exercise the ankle-foot complex by moving the foot through dorsiflexion and plantarflexion motions while in various positions. Thus, the exercise device has the advantages of not requiring the constant attention of a physical therapist, and a therapist can work with many users at the same time. Further, in the appropriate situations, the therapeutic exercises may be done in a home environment, thereby providing more convenient, consistent and less expensive therapy. The ankle exercise device of the present invention is especially useful with severe ankle deficits, for example, foot drop, in which there is no or very limited muscular control over the foot.

According to the principles of the present invention and in accordance with the preferred embodiment, an ankle exercise device includes a lower leg section receiving a calf portion of a lower leg of a user and a foot section receiving a foot of the user. The foot section is rotatably connected to the lower end of the lower leg section; and a rigid control rod has one end connected to the foot section and an opposite end held by the user. Thus, as the user successively pushes and pulls the control rod, the foot section is pivoted with respect to the lower leg section, thereby exercising the ankle-foot complex.

In one aspect of the invention, the lower end of the control rod is releasably attached to a connector near the toe end of the foot section. Further, the connector may be located on the foot section at different locations to vary the ankle exercise.

These and other objects and advantages of the present invention will become more readily apparent during the following detailed description taken in conjunction with the drawings herein.

DETAILED DESCRIPTION OF THE INVENTION

Figures 1, 2, 3, 4A, 4B:
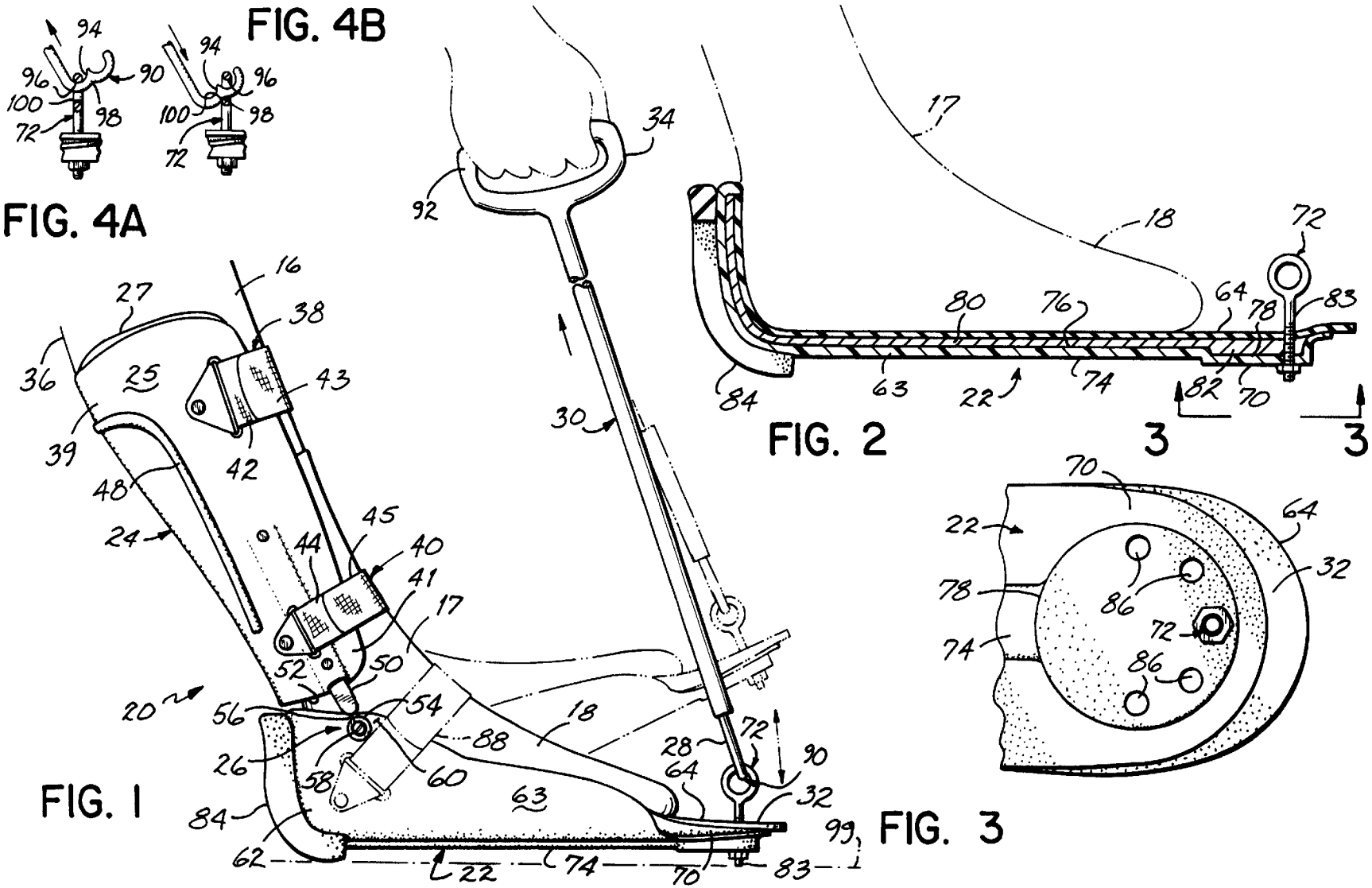
FIG. 1 is a side elevation view of one side of an ankle exercise device shown at the end of both plantarflexion and dorsiflexion motions in accordance with the principles of the present invention.
FIG. 2 is a longitudinal cross-sectional of the foot section of FIG. 1.
FIG. 3 is a partial bottom view of the foot section shown at line 3—3 of FIG. 2.
FIGS. 4A and 4B are front views of the forward portion of the foot section and illustrate how the control rod is used to operate the exercise device in accordance with the principles of the present invention.

Referring to FIG. 1, the lower portion of the leg or shank 16, ankle 17 and foot 18 of a user are illustrated. The user can be in a variety of positions but, normally is in a sitting or supine position such that the lower leg and foot extend forward. The greater the forward extension of the foot 18, the greater the range of dorsiflexion and plantarflexion motions. The ankle exercise device 20 of the present invention is comprised of a foot section or plate 22 and a lower leg section or support 24 that are connected together at pivot joint 26 such that the foot section 22 articulates with respect to the lower leg section 24. The pivot joints 26 are located such that a line passing through the pivots joints 26 is generally parallel to the horizontal axis of rotation of the ankle 17. One end 28 of a push-pull control rod 30 is connected to the distal end 32 of the foot section 22. The opposite end 34 of the control rod 30 is grasped in the hand (shown in phantom) of a user or care giver.

By successively pushing and then pulling on the rod, the foot section 22 pivots upward and then downward, respectively, thereby moving the foot 18 through successive dorsiflexion and plantarflexion motions. Thus, the user or care giver can control the relationship of the foot and lower leg sections 22, 24 and thus, control the action or motion of the foot with respect to the ankle joint.

Referring to the structure of the exercise device 20 in more detail, the lower leg section 24 is curved or generally U-shaped with respect to its longitudinal axis to receive the calf 36 of the lower leg 16. The lower leg section 24 is preferably made from a thin lightweight vacuum formed copolymer plastic shell 25 that is covered on an inner surfaces with a liner 27. The liner 27 is normally made from one or more layers of padding or cushioning material, for example, cloth and/or foam rubber, etc., such that the leg section 24 comfortably receives the calf 36 of a leg of the user. A first fastener 38 is connected near an upper end 39 of the lower leg section 24; and a second fastener 40 is connected to near an opposite, lower end 41 of the lower leg section 24. The first fastener 38 may, for example, be comprised of straps 42, 43; and the second fastener may, for example, be comprised of straps 44, 45. Each of the straps 42–45 has one end connected to one side of the lower leg section 24. The other, loose end of each of the straps 42–45 is wrapped over the anterior portion of the lower leg 16 and secured to another strap by a buckle, VELCRO fastener or other means (not shown). Alternatively, a single strap may be used and buckled or fastened to an opposite side of the lower leg section 24. The lower leg section 24 also includes a generally U-shaped reinforcing rib 48 that extends generally symmetrically with respect to a longitudinal center line of the lower leg section 24 and provides triplanar rotary stability.

A pivot link 50 is attached to the lower end 41 on each side of the lower leg section 24. Each of the pivot links 50 extends beyond a bottom edge 52 of lower leg support 24 and terminates with an eyelet 54. Normally, the eyelet 54 is supported on an end of a shaft 56 that is threaded into the distal end of the pivot link 50, thereby providing an adjustment for the location of each of the pivot joints 26 with respect to each other and also the location of the lower leg section 24 with respect to the foot section 22. A pivot pin 58 is inserted through each of the eyelets 54 and a respective upper side 60 at the heel end 62 of the foot section 22. Preferably, each of the pivot pins 58 extends through a metal grommet (not shown) also extending through a respective upper side wall 60 of the foot section 22. The grommet is preferably made of a material which provides relatively high wear resistance with respect to the pivot pin 58 extending therethrough. The centerlines of the pivot pins 58 define an axis of rotation of the pivot joints 26.

With some therapies, the shafts 56 may be adjusted such that an axis of rotation passing through the pivot joints is generally parallel with the a horizontal axis of ankle rotation. In other words, the longitudinal centerline the lower leg section 24 generally lies in a plane that is perpendicular to the axis of rotation of the pivot joints 26 and passes through the longitudinal centerline of the foot section 22. With other therapies, it may be desirable to adjust the shafts 56 to different lengths, thereby twisting the foot section 22 with respect to the lower leg section 24. In that situation, the longitudinal centerline the lower leg section 24 is skewed with respect to a plane that is perpendicular to the axis of rotation of the pivot joints 26 and passes through the longitudinal centerline of the foot section 22.

It should also be noted that the foot section 22 can pivot through a wide range of angular motion with respect to the lower leg section 24, and in particular, the foot section can pivot to form obtuse angles with respect to the lower leg section 24. Therefore, the foot section 22 can be moved to provide a wide range of plantarflexion motion of the foot with respect to the lower leg.

The foot section 22 is shaped so that a foot is comfortably received by the foot section 22. The foot section 22 is preferably made from a thin lightweight vacuum formed copolymer plastic shell 63 that is normally covered on its upper inside surfaces with a liner 64. The liner 64 is normally made from one or more layers of padding or cushioning material, for example, cloth and/or foam rubber, etc., such that the foot section 22 comfortably receives the foot 18. The foot section 22 extends over the area of the sole and heel of the foot 18 and has sides sufficient height to receive the pivot joint 26.

The toe end 70 of the foot section 22 extends beyond the toes of the foot 18 and a connector or receptor 72 is located at the toe end 70 of the foot section 22. The receptor 72 is connectable to the one end 28 of the control rod 30. The receptor may take the form of a closed eyelet or an open eye hook. Further, the one end 28 of the control rod 30 is normally shaped to form a hook such that the control rod may be readily inserted into and removed from the receptor 72. Alternatively, the one end 28 of the control rod may be permanently connected to the toe end 70 of the foot section 22.

Referring to FIG. 2, to provide longitudinal rigidity for the foot section 22 and a reliable anchor for the receptor 72, the foot section 22 includes a molded channel 74 having a first linear section 76 extending along the longitudinal centerline of the foot section 22. The linear channel 76 intersects a circular channel 78 at the toe end 70 of the foot section 22. A rigid bar 80 is disposed within the linear channel 74 and is connected to the foot section 22 by fasteners, adhesive or other means (not shown). A circular plate 82 is sized to fit within the circular channel 78 and is connected to the receptor 72 by a threaded shaft 83 or other fastener. The plate 82 may be integral with or separate from the bar 80. The plate 82 provides an anchor for the receptor 72 so that as the receptor is pushed and pulled, it remains secured to the foot section 22 with minimal wear to the plastic shell 61.

A heel pad or plate 84 is secured to the heel end 62 of the foot section 22 and is preferably made from a high resistance material, for example, high density foam rubber, such that the heel plate 84 prevents the foot section 22 from sliding on normal floor surfaces such as wood, tile, carpeting, etc.

In use, the lower leg 16 of the user is inserted in the lower leg section 24 and foot 18 is placed in the foot section 22. The fasteners 38, 40 are connected to secure the exercise device 20 to the user. The user then assumes a sifting or supine posture to use the exercise device. If a sitting posture is used, the user's foot is extended forward along the floor 99, and that motion bends the foot with respect to the ankle in the direction of the plantarflexion motion. As shown in FIG. 4A, one end 28 of the control rod 30 has a control rod operator or hook portion 90 that is coupled or inserted into the receptor 72. A first, upward directed, notch or curved portion 94 on the upper side of the control rod operator or hook 90 engages a first surface, for example, an downward directed surface 96 of the receptor 72. The other end 34 of the control rod 30 may include a handle portion 92 held by the user or care giver. As the control rod 30 is pulled by the user or care giver, the hook 90 pulls on the receptor 72 to pivot the foot section 22 upward about the pivot joint 26 with respect to the stationary lower leg section 24. The control rod 30 is normally pulled upward to the full extent of the dorsiflexion motion.

Referring to FIG. 4B, the control rod operator or hook portion 90 has a second, downward directed, notch or curved portion 98 on its lower side that contacts with another surface, for example, an upward directed surface 100 of the receptor 72. As the user or care giver uses the handle 92 to push on the control rod 30, the hook 92 pushes on the receptor 72 to pivot the foot section 22 downward about the pivot joint 26 with respect to the stationary lower leg section 24. Pushing the control rod 30 pivots the foot 18 and foot section 22 through the plantarflexion motion back to the starting position at which the foot section 22 is resting flat on the floor surface 99.

Thus, as the control rod 30 is moved generally longitudinally in repeated push and pull cycles, the foot section 22 is repeatedly pivoted in downward and upward cycles about the pivot joint 26 and with respect to the stationary lower leg section 24. Further, during the pushing and pulling action of the control rod 30, the motion of the foot section 22 is maintained along a desired path consistent with the dorsiflexion and plantarflexion motions.

The control rod 30 may be operated either by the user or a care giver and provides complete control over the motion of the foot 18 with respect to the lower leg 16. With a foot drop ankle deficit, continued use of the ankle exercise device 20 may provide muscular rehabilitation to the user, thereby reducing the foot drop deficit. With motor control of the foot, the exercise device 20 may be used to provide negative resistance to the user's dorsiflexion and plantarflexion foot motions.

The ankle exercise device 20 is a simple, inexpensive, reliable ankle exerciser which is suitable for severe ankle deficits, for example, foot drop, and can be easily used by a user or care giver in both clinical and home environments. The exercise device has the advantages of not requiring the constant attention of a physical therapist, and thus a therapist can work with many users at the same time. Further, in the appropriate situations, the therapeutic exercises may be done in a home environment, thereby providing more convenient, consistent and less expensive therapy. The ankle exercise device of the present invention is especially useful with severe ankle deficits, for example, foot drop, in which there is no or very limited muscular control over the foot.

Further, the exercise device 20 gives the user control and allows for a free range of motion of the foot and also permits the user to control, regulate and improve the passive range of motion. The exercise device 20 facilitates active muscle function and permits controlled, regulated resistance to both plantarflexion and dorsiflexion motion. The exercise device 20 will function muscle groups on a concentric or eccentric control in an isotonic, isometric or isokinetic fashion and can increase strength and retrain muscle groups for improved function. With such versatility, the ankle exercise device 20 can help rebuild neurological "bridges" on multiple levels.

While the invention has been illustrated by the description of one embodiment, and while the embodiment has been described in considerable detail, there is no intention to restrict nor in any way limit the scope of the appended claims to such detail. Additional advantages and modifications will readily appear to those who are skilled in the art. For example, in the above described embodiment, the receptor 72 is located approximately on a longitudinal centerline of the foot section 22. As will be appreciated, there may be situations in which it is desirable to apply the forces from the control rod 30 at a different location on the foot section 22. For example, different muscle groups around the foot and ankle may have different strengths, and it is desirable to focus on one group in particular. There may be other reasons for wanting to apply a slight torque to the foot section 22 during the exercise. In those situations, the circular plate 82 has other holes 86 (FIG. 3) to which the receptor 72 may be connected, thereby varying the exercise in a desired manner. In other applications, the receptor 72 may be permanently located at a single location and manufactured as an integral part of the foot section or a part thereof.

The exercise device of the invention has been described as being used with the user in a sitting or supine position; however, as will be appreciated, there are deficits of the ankle-foot complex for which it may be desirable for the user to use the exercise device while in the standing position. Clearly, any use of the exercise device by a user in the standing position should only be done with the assistance of a care giver or other professional.

While the exercise device of the invention uses straps 42, 43, 44, 45 located on the lower leg section 24, those straps may be positioned at other locations of the leg section 24. As will be appreciated, additional straps may be used, for example, by the straps 88 (shown in phantom in FIG. 1) on the foot section 22. Alternatively, the strap 80 may be used in place of straps on the leg section 24, for example, straps 44, 45. Further, although not shown, the control rod 30 may be adjustable to different lengths in a known manner as is done with adjustable canes. While the pivot joint 50 is illustrated with a particular construction, any other joint construction may employed that permits the foot section 22 to pivot about a single axis with respect to the lower leg section 24.

As will be appreciated, the end 28 of the control rod 30 may have a variety of configurations. For example, the hook portion 90 may be permanently connected to the receptor 72. The hook portion 90 and receptor 72 may be differently configured, for example, as a slot and bayonet type of coupling, or any other permanent or temporary coupling structure that best serves the needs of the user.

In addition, the laminated construction of the foot and leg sections 22, 24 may be varied in known ways. For example, those sections 22, 24 may be made with different shapes from different materials using different molding processes. For example, the foot and lower leg sections 22, 24 may be made to different sizes. In addition, as is well known, different liners and padding may be used to suit the individual needs of a user. For example, the liner 64 may be optional with the user. Further, the foot section 22 may be may as a universal foot section that accommodates either the left or right foot. Alternatively, foot sections 22 may be shaped to accommodate either the left foot or the right foot.

Therefore, the invention in its broadest aspects is not limited to the specific details shown and described. Consequently, departures may be made from the details described herein without departing from the spirit and scope of the claims which follow.

What is claimed is:

1. An ankle-foot complex exercise device comprising:

a lower leg section having an upper end and a lower end and adapted to receive a portion of a lower leg of a user;

a foot section having a heel end and a toe end and adapted to receive a foot of the user, the foot section being pivotally connected to the lower end of the lower leg section, the toe end of the foot section having a connector; and a rigid, manually-operable control rod having one end releasably engagable with the foot section and an opposite end adapted to be held by the user, the one end of the manually-operable control rod having an upward directed surface contacting a downward directed surface of the connector to facilitate pulling the foot section in an upward pivoting motion with respect to the lower leg section, and a downward directed surface contacting an upward directed surface of the connector to facilitate pushing the foot section in a downward pivoting motion with respect to the lower leg section, the manually-operable control rod pivoting the foot section in opposite directions with respect to the lower leg section as the manually-operable control rod is pushed and pulled by the user, thereby exercising the ankle-foot complex.

2. The exercise device of claim 1 wherein the lower leg section has a first fastener for securing the lower leg section to the lower leg.

3. The exercise device of claim 2 wherein the first fastener on the lower leg section is located closer to the upper end than the lower end.

4. The exercise device of claim 3 wherein the first fastener on the lower leg section includes a strap.

5. The exercise device of claim 3 wherein the lower leg section has a second fastener for securing the lower leg section to the lower leg.

6. The exercise device of claim 5 wherein the second fastener on the lower leg section is located closer to the lower end than the upper end.

7. The exercise device of claim 6 wherein the second fastener on the lower leg section includes a strap.

8. The exercise device of claim 2 wherein the foot section has a fastener for securing the foot section to the foot of a user.

9. The exercise device of claim 8 wherein the fastener on the foot section is located closer to the heel end than the toe end.

10. The exercise device of claim 9 wherein the fastener on the foot section includes a strap.

11. The exercise device of claim 1 wherein the one end of the manually operable rod comprises a hook with opposed curved portions.

12. The exercise device of claim 1 wherein the foot section has a plurality of locations for connecting the connector.

13. The exercise device of claim 1 wherein the foot section is pivotally mounted with respect to the lower leg section to provide an exercise axis of rotation generally colinear with an axis of rotation of an ankle of the user.

14. The exercise device of claim 1 wherein the foot section has a heel plate providing a relatively high friction nonslip contact with a floor.

* * * * *